United States Patent [19]

Higuchi

[11] 4,029,053

[45] June 14, 1977

[54] COOLING BOX FOR METALLURGICAL FURNACE

[75] Inventor: Masaaki Higuchi, Fukuyama, Japan

[73] Assignee: Nippon Kokan Kabushiki Kaisha, Tokyo, Japan

[22] Filed: Mar. 24, 1976

[21] Appl. No.: 670,004

[30] Foreign Application Priority Data

Mar. 28, 1975 Japan ..... 50-40876[U]

[52] U.S. Cl. ..... 122/6.5; 266/265

[51] Int. Cl.[2] ..... F22B 37/00

[58] Field of Search ..... 122/6 R, 6 B, 6.5, 6.6; 266/190, 241, 265

[56] References Cited

UNITED STATES PATENTS

| | | | |
|---|---|---|---|
| 840,195 | 1/1907 | Berry | 122/6 |
| 3,628,509 | 12/1971 | Becker | 122/6.5 |

*Primary Examiner*—Kenneth W. Sprague

[57] ABSTRACT

A cooling box for a metallurgical furnace comprising an independent and outermost first cooling water channel turning back in the front end part of the cooling box to form itself into a loop, a second cooling water channel turning back to form itself into a loop along the inner side of said first cooling water channel and a third cooling water channel turning back along the inner side of the second cooling water channel and communicating with the second cooling water channel at one end thereof.

5 Claims, 5 Drawing Figures

COOLING BOX FOR METALLURGICAL FURNACE

The present invention relates to a cooling box of the type for cooling the furnace walls or furnace doors of metallurgical furnaces such as blast furnaces.

The cooling boxes for metallurgical furnaces, a typical example of which is used for cooling shaft walls of a blast furnace, are generally embedded in the brickwork of the furnace walls or doors, and water is continuously supplied as a cooling medium from outside into the cooling boxes to improve the thermal resistance of the furnace walls as well as to improve the abrasive resistance of the furnace walls against the charges loaded into the furnace. At the same time, the cooling boxes prevent the breakdown of the furnace walls or doors by acting as barriers if a fusion failure of the brick work should occur.

The cooling boxes which have heretofore been used widely are of the following construction. The most simple form is one in which a partition plate is disposed in the inner central portion of a box body of depressed shape so that cooling water supplied through an inlet port on one side of the box is turned back round the forward end of the partition plate and discharged through an outlet on the other side of the box. However, this type of cooling box has the disadvantage of necessitating the complete stoppage of the supply of cooling water in the event of a failure of the cooling box due to fusion and therefore, with a view to overcoming this deficiency, the cooling box of another construction is known in the art in which an outer cooling water channel, and inner cooling water channel which are provided independently each of other inside a cooling box with their own separate water circulating lines, so that when the outer shell of the cooling box fails due to its fusion, only the supply of water to the outer cooling water channel is stopped and the cooling water is continuously supplied to the inner cooling water channel. Of these two constructions, the latter is superior in cooling effect to the former, and the latter is advantageous over the former in the event of a partial external failure by fusion. However, with large capacity metallurgical furnaces, particularly the recently constructed large blast furnaces, the cooling boxes of the above-mentioned types have been unable to provide satisfactory cooling effect and thus there has been sought an improved cooling box of the type which can provide heightened cooling effect, particularly in the front end part of the cooling box to prevent the danger of the cooling box being broken down due to fusion.

Another disadvantage of the above-described conventional cooling boxes is that the length of the flow path of the cooling water channel is simply elongated by the provision of the partition plates with no increase in the flow velocity, and moreover the direction of flow of the water in the cooling water channel changes many times and the flow direction changes sharply in some parts resulting in the generation and retension of vapor in these parts due to the heating of cooling water, thus deteriorating the cooling effect. Further, any attempt for improving the cooling effect through the use of a more complicated configuration for the cooling water channels only tends to make the casting operation of cooling boxes more difficult such as the removed of casting sand, etc.

It is therefore an object of the present invention to provide an improved cooling box which overcomes the foregoing deficiencies, has heightened provides for an increased cooling effect and is easy to manufacture.

A better understanding of the present invention may be had from the following detailed description taken in conjunction with the accompanying drawings, in which.

Figure 1:
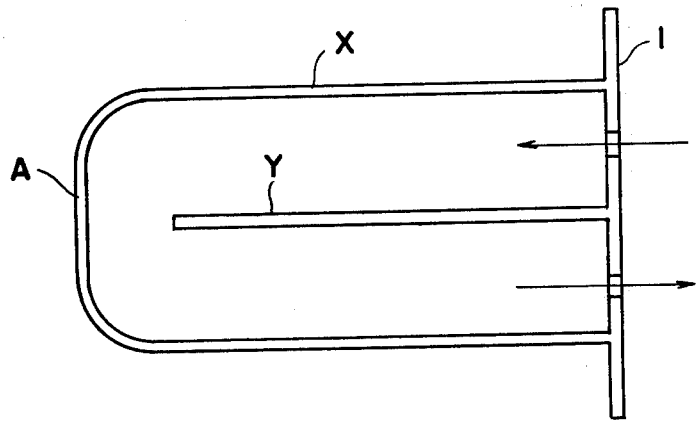
FIG. 1 is a schematic horizontal sectional view showing a conventional cooling box of the most simple construction.
Figure 2:
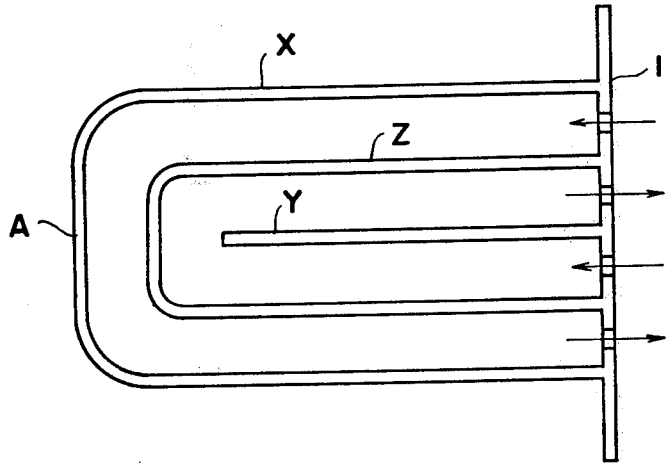
FIG. 2 is a schematic horizontal sectional view showing another conventional cooling box of an improved construction.

Referring first to FIGS. 1 and 2 showing two different types of conventional cooling boxes, numeral 1 designates the flange formed on the tail end part of the cooling box (hereinafter referred to as a tail flange) for fitting the cooling box on the shell of a metallurgical furnace, A the front end part of the cooling box, X the side wall of the cooling box, Y and Z the partition walls of the cooling box, and the arrows show the directions of flow of cooling water. The cooling box of FIG. 1 comprises a single cooling water channel designed to turn back after passing round the forward end of the partition wall Y in the front end part A, and the cooling box of FIG. 2 comprises a pair of independent outer and inner cooling water channels designed to turn back and also separated from each other by the partition wall Z. With these cooling boxes, the number of the cooling water channels provided by dividing the interior of each cooling box is small, with the result that the cross-sectional area of the cooling water channels is large and the velocity of cooling water is low thus deteriorating the cooling effect. On the other hand, to increase the velocity of cooling water, the use of a particularly powerful water supply system is required or alternately the size of the cooling box itself must be diminished resulting in the disadvantage that it is necessary to increase the number of cooling boxes used. Further, in the cooling box of FIG. 1 as well as in the cooling box of FIG. 2, the direction of cooling water flow changes sharply near the front end of the cooling box where the cooling water goes round the forward end of the partition wall Y, so that the cooling water tends to be heated to elevated temperatures and the generation and retention of vapor are liable to occur as mentioned above, thus deteriorating the cooling effect.

A cooling box according to this invention comprises a first cooling water channel, provided along the inner side of the side plate of the cooling box, which starts from the tail flange of the cooling box, forms itself into a loop in the front end part of the cooling box and turns back to the tail flange, a second cooling water channel, provided along the inner side of the first cooling water channel, which starts from the tail flange, formes itself into a loop at a position near the front end part of the cooling box and turns back to the tail flange, and a third cooling water channel, provided along the inner side of the second cooling water channel, which has one end thereof communicating with one end of the second cooling water channel, passes round the forward end of a partition wall and turns back to the tail flange. Thus, with the cooling box of this invention, the interior of the cooling box is divided into a greater number of cooling water channels than in the conventional cooling boxes whereby the cross-sectional area of the cooling water channels is narrowed, increasing the velocity of cooling water and heightening the cooling effect. Such a cooling box is easy to construct in spite of its increased number of the cooling water channels.

Figure 3:
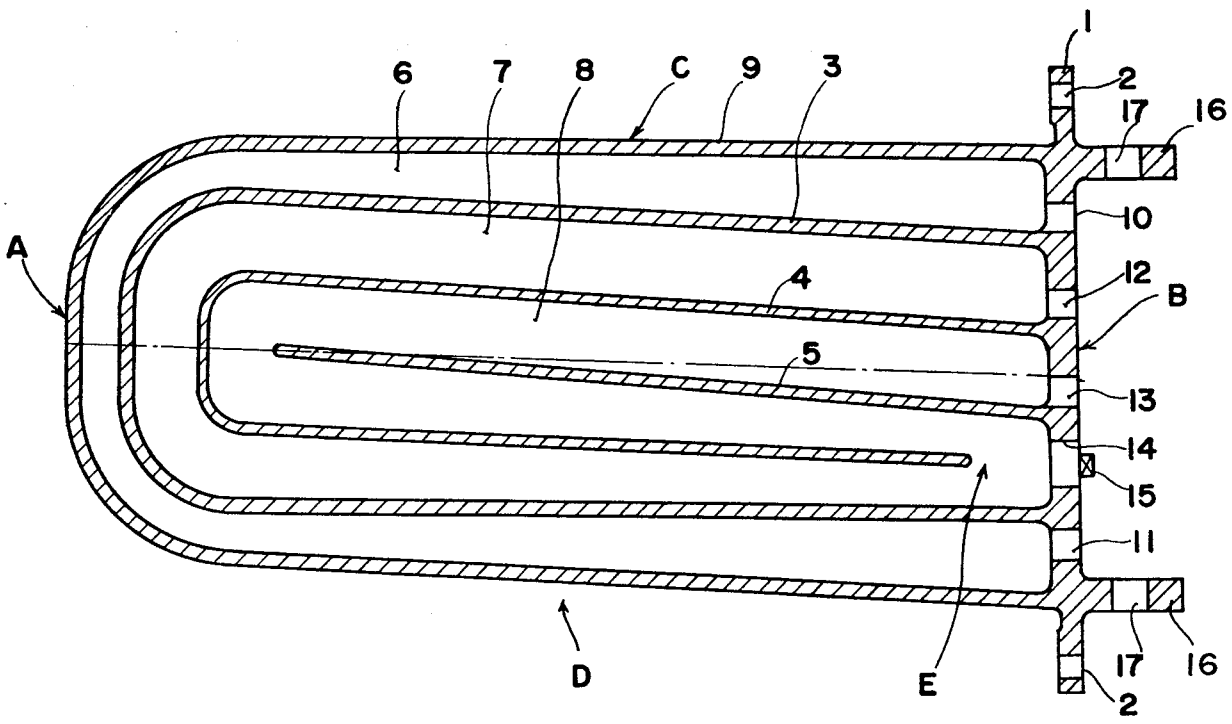
FIG. 3 is a horizontal sectional view showing a cooling box according to an embodiment of this invention.
Figure 4:
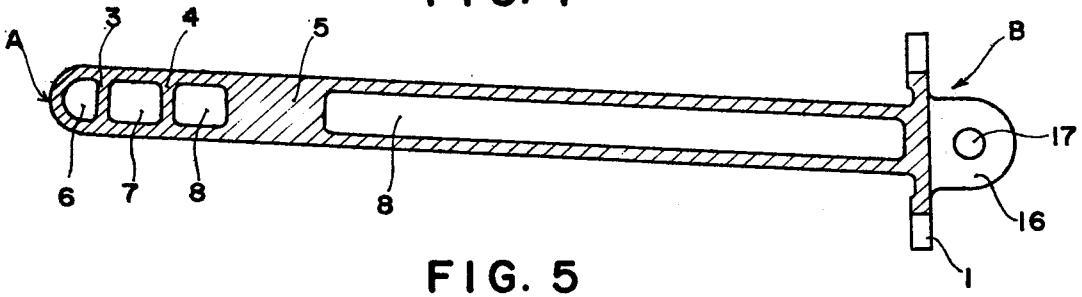
FIG. 4 is a central longitudinal sectional view of the cooling box shown in FIG. 3.
Figure 5:
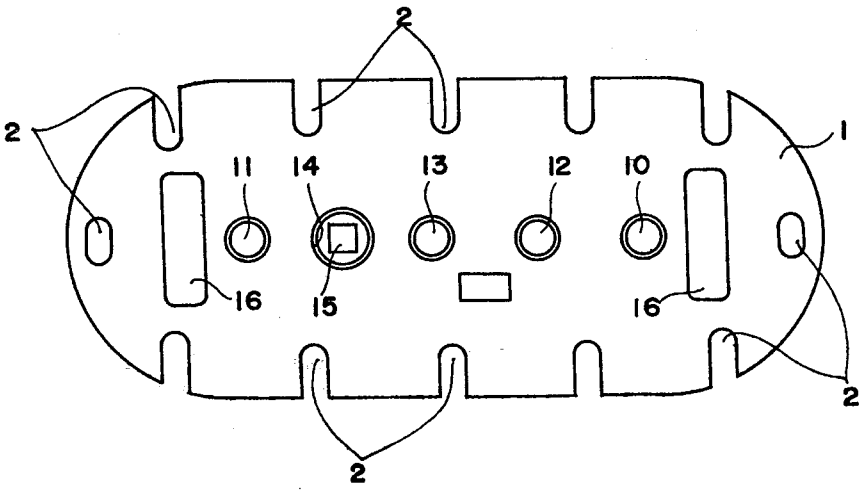
FIG. 5 is a back view showing the tail end part of the cooling box shown in FIG. 3.

As shown in FIGS. 3 through 5, the cooling box of this invention is formed into a depressed shape and is inserted, with its front end part directed toward the inside of a metallurgical furnace such as a blast furnace, into a correspondingly shaped opening formed in the furnace wall, when the cooling box is held firmly in place by screwing bolts through bolt holes 2 in a flange 1 of a tail end part B into the metal frame attached to the shell at the mounting position of the furnace wall.

The interior of the cooling box is divided by means of partition walls 3, 4 and 5 into a plurality of cooling water channels 6, 7 and 8 in such a manner that the lengthwise variation in the width of each channel is small.

The independent and outermost first cooling water channel 6 is provided between a side plate 9 and the first partition wall 3 of the cooling box to extend along one side C, the front end part A and the other side D of the cooling box and turn back forming itself into a loop in the front end part A, the second cooling water channel 7 is defined by the first and second partition walls 3 and 4 along the inner side of the first cooling water channel 6, and the third cooling water channel 8 is defined by the second and third partition walls 4 and 5 so as to extend along the inner side of the second cooling water channel 7 and to turn back passing round the forward end of the partition wall 5.

The cooling water channels 6, 7 and 8 are provided so that the ends of the respective channels terminate in the tail end part B of the cooling box. The second and third cooling water channels 7 and 8 communicate with each other at the point designated as E in FIG. 1, and in this way the cooling water channels 7 and 8 constitute a separate water circulating system which is independent of the first cooling water channel 6.

The flange 1 of the tail end part B is provided with openings for circulating cooling water 10, 11, 12 and 13 in the portions corresponding to the respective cooling water channels at the ends of the first cooling water channel 6 and the respective one end of the second and third cooling water channels 7 and 8. A peeping hole and/or core sand removing hole 14 is formed in the part E, and a stopper plug 15 is normally fitted into the hole 14 to prevent the leakage of the cooling water.

While the cooling water channels in the cooling box of this invention are greater in number than in the conventional cooling boxes with a resulting decrease in the width thereof, the cross-sectional area of the outermost first cooling water channel 6 should desirably be narrowed to increase the internal flow velocity, and it is also preferable to arrange the partition wall 3 such that the cross-sectional area is further narrowed in the vicinity of the front end part A. In the Figures, numerals 16 designate vertical flanges having holes 17 which are engaged with holding means during the fitting and removing operations.

With the cooling box this invention, by virtue of the fact that the first cooling water channel 6 which is directly contact with the high temperature part of the furnace, and the second cooling water channel 7 which is in contact with the first cooling water channel 6 tending to be heated to relatively elevated temperatures are designed to form themselves into loops as mentioned above despite the narrow width of the cooling water channels, the cooling water flows smoothly and at high speeds preventing the turbulent flow of the cooling water and the retention of vapor and heightning the cooling effect. On the other hand, although the third cooling water channel 8 is designed to sharply turn back around the forward end of the partition wall 5, there is no possibility of causing any difficulty owing to the relatively low temperatures of the cooling water in the cooling water channel 8. Further, by virtue of the fact that the flow direction of cooling water in the second cooling water channel 7 is opposite to that in the third cooling water channel 8, and that the flow directions of cooling water may be made opposite in the first and second cooling water channels 6 and 7, the cooling effect of the cooling box throughout its entire surface may be made rather uniform.

Furthermore, while it has been customary to construct the cooling boxes of this type by casting a metal having high heat conductivity such as copper or its alloys, by virtue of the fact that the cooling water channels defined inside the cooling box are arranged in the lengthwise direction of the cooling box and a total of five openings 10, 11, 12, 13 and 14 are provided in the tail end part, the removal of casting sand in casting the cooling box may be effected smoothly, and moreover simultaneous one-piece casting is possible despite the multiple-channel construction that fully satisfies the desired cooling effect.

It will thus be seen from the foregoing description that the cooling box of this invention is advantageous in that the flow velocity in the cooling water channels, particularly in the front end part of the cooling box is increased without the impediment to the removal of sand in casting the cooling box despite the narrowed cross-sectional area of the channels, so that the possibility of a failure by fushion of the cooling box itself may be prevented more effectively. Another advantage is that the provision of an increased number of partition walls has the effect of improving the strength of the cooling box in the vertical direction thereof, and therefore if, for example, the front end part of the cooling box is exposed to the interior of the furnace, damage to the cooling box due to the percussions by the charges falling in the furnace may be effectively prevented. Thus, the invention has many industrial advantages.

What is claimed is:

1. A cooling box of depressed shape having a front end part (A) for a metallurgical furnace having a plurality of partition walls, a plurality of cooling water channels being defined therein said cooling box comprising a tail flange, a first side plate having an inner side, a first cooling water channel (6), being provided along the inner side of said side plate (9), formed itself into a loop in the front end part (A) of said cooling box and turning back to said tail flange (1), said first cooling channel starting from said tail flange, a second cooling water channel (7), provided along the inner side of said first cooling water channel (6), starting from said tail flange (1), forming itself into a loop at a position near said front end part (A) of said cooling box and turning back to said tail flange (1), and a third cooling water channel (8), provided along the inner side of said second cooling water channel (7), having one end thereof communicating with one end of said second cooling water channel (7), passing around the forward end of one of said partition walls (5) and turning back to said tail flange (1), the width of said first cooling water channel along the front end part of said cooling box being narrowed, whereby cooling water flows smoothly and at high speeds in said cooling channels.

2. A cooling box as claimed in claim 1, wherein the directions of flow of cooling water in adjacent cooling water channels are opposite to each other.

3. A cooling box as claimed in claim 1, said tail flange at the ends of said first cooling water channel, at said one end of said second cooling water channel and at said one end of said third cooling water channel, being formed with a plurality of openings, and a hole being provided in said tail flange at the point of communication between said second and third cooling water channels, whereby casting of the cooling box is facilitated.

4. A cooling box as claimed in claim 3, wherein said hole is a peeping hole.

5. A cooling box as claimed in claim 3, wherein said hole is a core-sand removing hole.

* * * * *